US006264277B1

(12) United States Patent
Lay

(10) Patent No.: US 6,264,277 B1
(45) Date of Patent: Jul. 24, 2001

(54) ARMREST SUPPORT ASSEMBLY

(76) Inventor: Ywh-Shan Lay, 4F-3 No.228, Tzu Yu Rd., Bao An, Jia Yi City (TW)

( * ) Notice: Subject to any disclaimer, the term of this patent is extended or adjusted under 35 U.S.C. 154(b) by 0 days.

(21) Appl. No.: 09/459,677

(22) Filed: Dec. 13, 1999

(51) Int. Cl.[7] ..... A47C 7/54

(52) U.S. Cl. ..... 297/411.2; 297/411.31; 297/411.36

(58) Field of Search ..... 297/411.2, 411.31, 297/411.35, 411.36

(56) References Cited

U.S. PATENT DOCUMENTS 5,318,347 * 6/1994 Tseng ..... 297/411.36
5,324,096 * 6/1994 Schultz ..... 297/411.36
5,368,365 * 11/1994 Feldberg ..... 297/411.36
5,388,892 * 2/1995 Tornero ..... 297/411.36
5,435,626 * 7/1995 Lai ..... 297/411.36
5,484,187 * 1/1996 Doerner et al. ..... 297/411.36 X
5,620,233 * 4/1997 Corwin ..... 297/411.36
5,664,842 * 9/1997 Tseng ..... 297/411.36
5,735,577 * 4/1998 Lin ..... 297/411.36
5,769,497 * 6/1998 Tsai ..... 297/411.36
5,951,107 * 9/1999 Tornero ..... 297/411.36 X
5,997,093 * 12/1999 Gollin et al. ..... 297/411.36
6,062,647 * 5/2000 Mei ..... 297/411.36

* cited by examiner

*Primary Examiner*—Peter M. Cuomo
*Assistant Examiner*—Rodney B. White
(74) *Attorney, Agent, or Firm*—Alan D. Kamrath; Rider, Bennett, Egan & Arundel, LLP

(57) ABSTRACT

An armrest support assembly has an armrest support frame and an elevator seat. The armrest support frame has an inner groove, a stepped slot, and a click hook, a post, and a threaded hole disposed on the opposite ends of the stepped slot. A positioning plate has through apertures matching the threaded holes of the armrest support frame. A bolt fastens each end of the positioning plate and the armrest support frame together. The elevator seat passes through the stepped slot of the armrest support frame. A top end of the elevator seat is inserted in the inner groove of the armrest support frame.

8 Claims, 7 Drawing Sheets

ARMREST SUPPORT ASSEMBLY

BACKGROUND OF THE INVENTION

The present invention relates to an armrest support assembly. More particularly, the present invention relates to an armrest support assembly which has an elevator seat and an armrest support frame disposed on the elevator seat.

Referring to FIG, 1, an armrest 10 is disposed on a conventional elevator seat 20. However, the contacting area between the armrest 10 and the conventional elevator seat 20 is very small so that the armrest 10 is easily detached from the conventional elevator seat 20 after a long period of usage. Furthermore, it is difficult to place the armrest 10 at a precise position on the conventional elevator seat 20 without any deviation of position.

SUMMARY OF THE INVENTION

An object of the present invention is to provide an armrest support assembly which has an armrest support frame disposed on the elevator seat in order to support an armrest stably.

Another object of the present invention is to provide an armrest support assembly which has an armrest support frame having a stepped slot in order to receive an elevator seat so that the armrest support assembly can be assembled easily.

Another object of the present invention is to provide an armrest support assembly which has an armrest support frame having a bottom portion engaging with a positioning plate to position an elevator seat so that a moment of force on an armrest can be reduced.

Accordingly, an armrest support assembly comprises an armrest support frame and an elevator seat. The armrest support frame has an inner groove formed in a top portion of the armrest support frame and, a stepped slot formed on a bottom portion of the armrest support frame. A positioning plate is fasten to the bottom portion of the armrest support frame. The elevator seat passes through the stepped slot of the armrest support frame between the bottom portion of the armrest support frame and the position plate. A top end of the elevator seat is inserted in the inner groove of the armrest support frame.

DETAILED DESCRIPTION OF THE INVENTION

Figure 1:
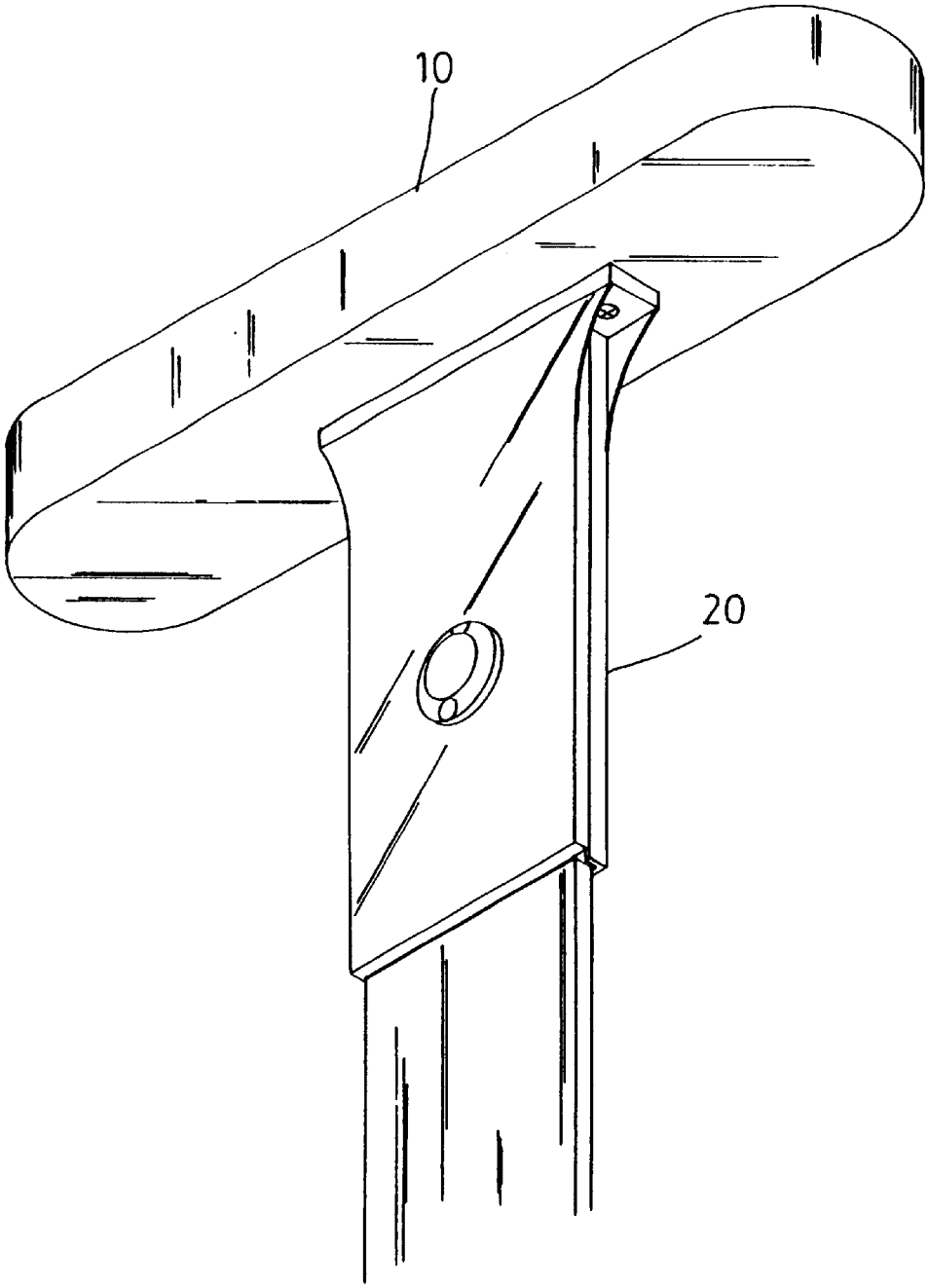
FIG. 1 PRIOR ART
FIG. 1 is a perspective assembly view of an armrest and an elevator seat of the prior art.
Figure 2:
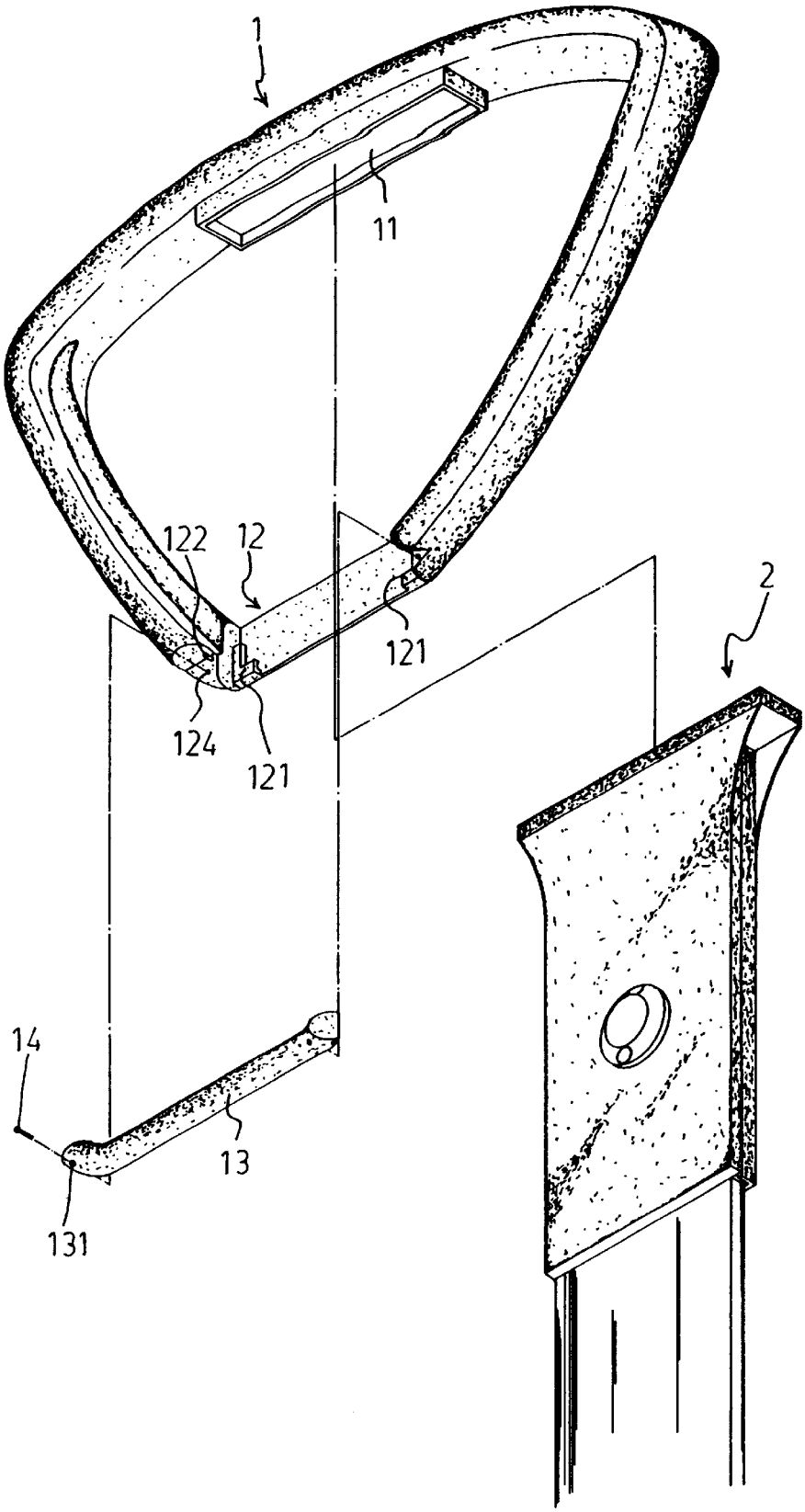
FIG. 2 is an exploded perspective view of an armrest support assembly of a first preferred embodiment in accordance with the present invention.
Figure 2A:
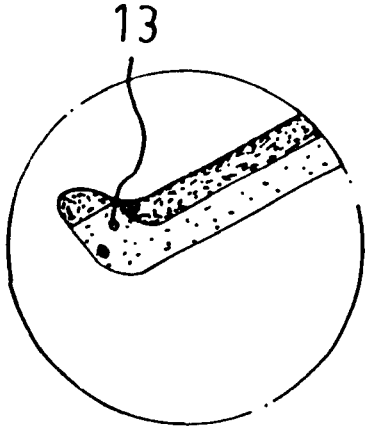
FIG. 2A is a partially enlarged perspective view of a positioning plate of a first preferred embodiment in accordance with the present invention.
Figure 3:
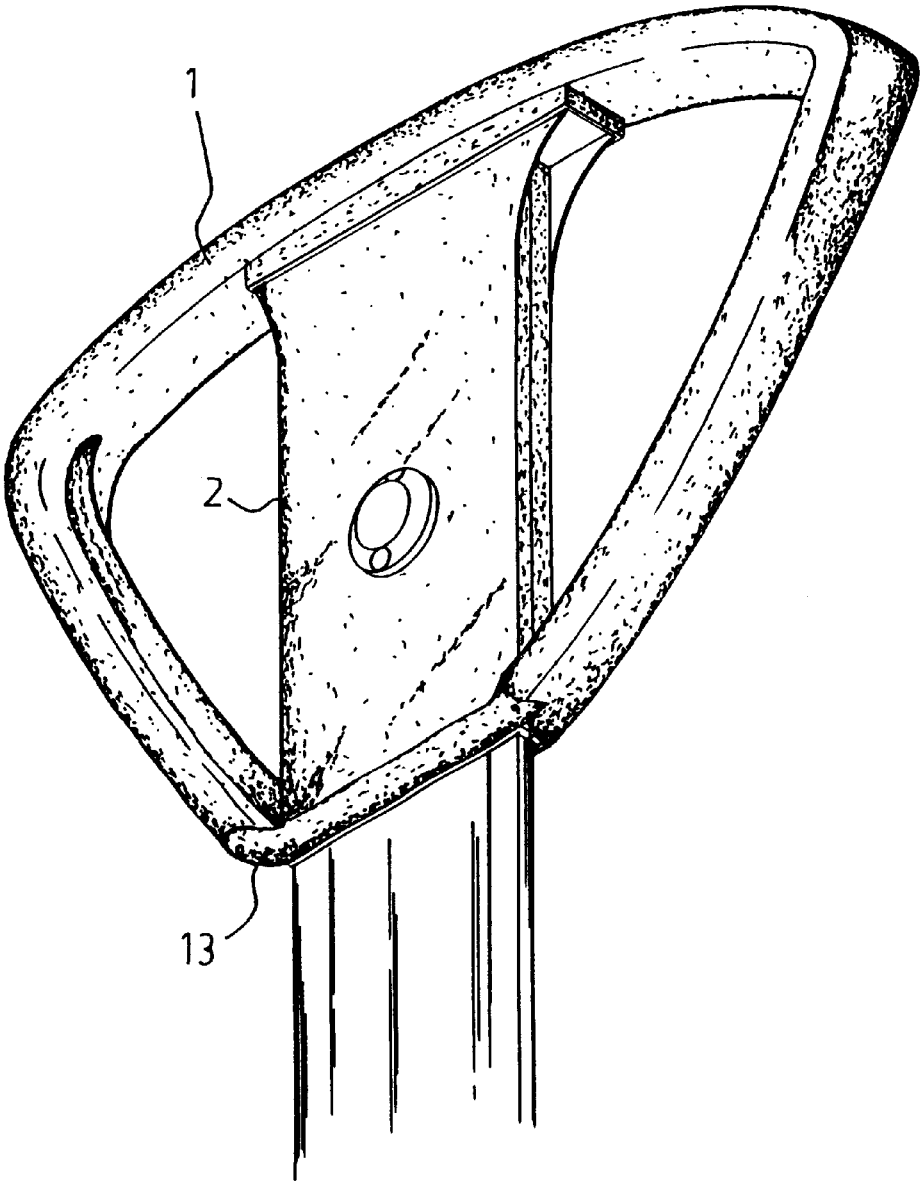
FIG. 3 is a perspective assembly view of an armrest support assembly of a first preferred embodiment in accordance with the present invention.
Figure 4:
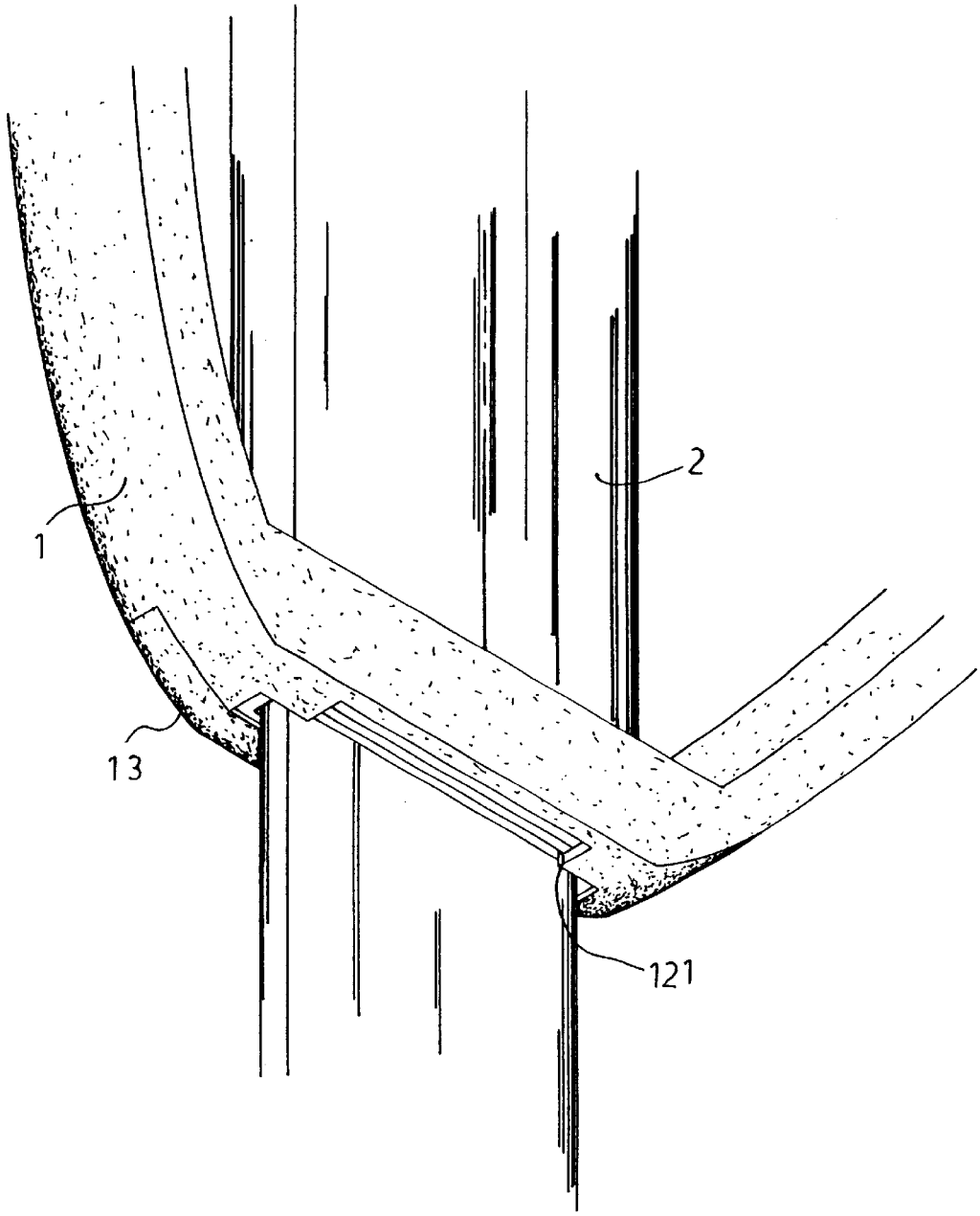
FIG. 4 is a partially enlarged perspective assembly view of a positioning plate and an armrest support frame of a first preferred embodiment in accordance with the present invention.

Referring to FIGS. 1 to 4, a first armrest support assembly comprises an armrest support frame 1 and an elevator seat 2.

The armrest support frame 1 has an inner groove 11 formed in A top portion of the armrest support frame 1, a stepped slot 12 is formed on a bottom portion of the armrest support frame 1. The armrest support frame 1 has two L-shaped click hooks 121 disposed on the opposite ends of the stepped slot 12. The armrest support frame 1 also a post 122 and a threaded hole 124 disposed on the bottom portion adjacent each end of the stepped slot 12.

Each end of a positioning plate 13 has a through aperture 131 matching the respective threaded hole 124 of the armrest support frame 1.

A bolt 14 fastens each end of the positioning plate 13 and the armrest support frame 1 together via the respective through aperture 131 of the positioning plate 13 and the respective threaded hole 124 of the armrest support frame 1.

The elevator seat 2 passes through the stepped slot 12 of the armrest support frame 1.

A top end of the elevator seat 2 is inserted in the inner groove 11 of the armrest support frame 1.

Figure 5:
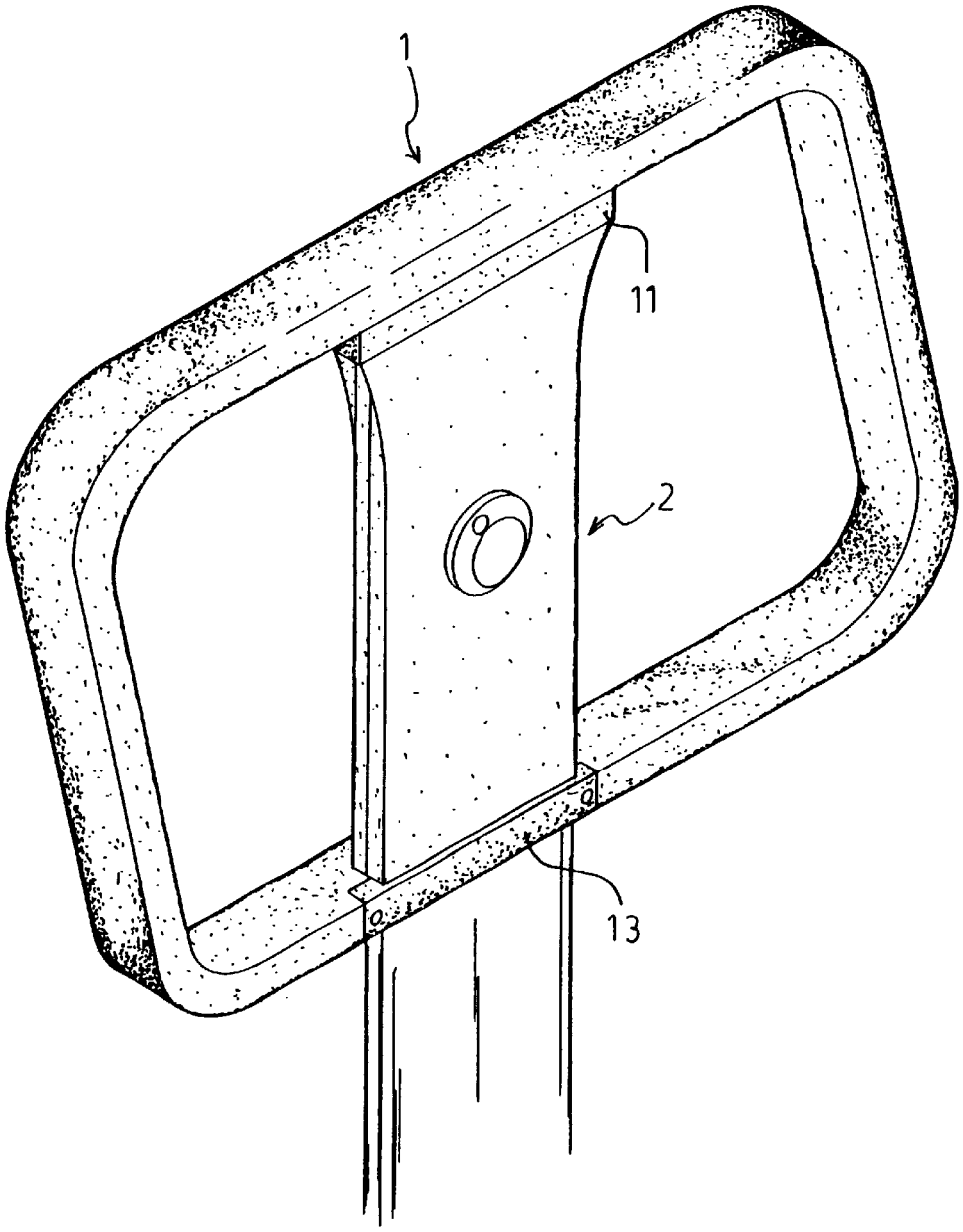
FIG. 5 is a perspective assembly view of an armrest support assembly of a second preferred embodiment in accordance with the present invention.

Referring to FIG. 5, a second armrest support assembly comprises an oblong-shaped armrest support frame 1 and an elevator seat 2.

Figure 6:
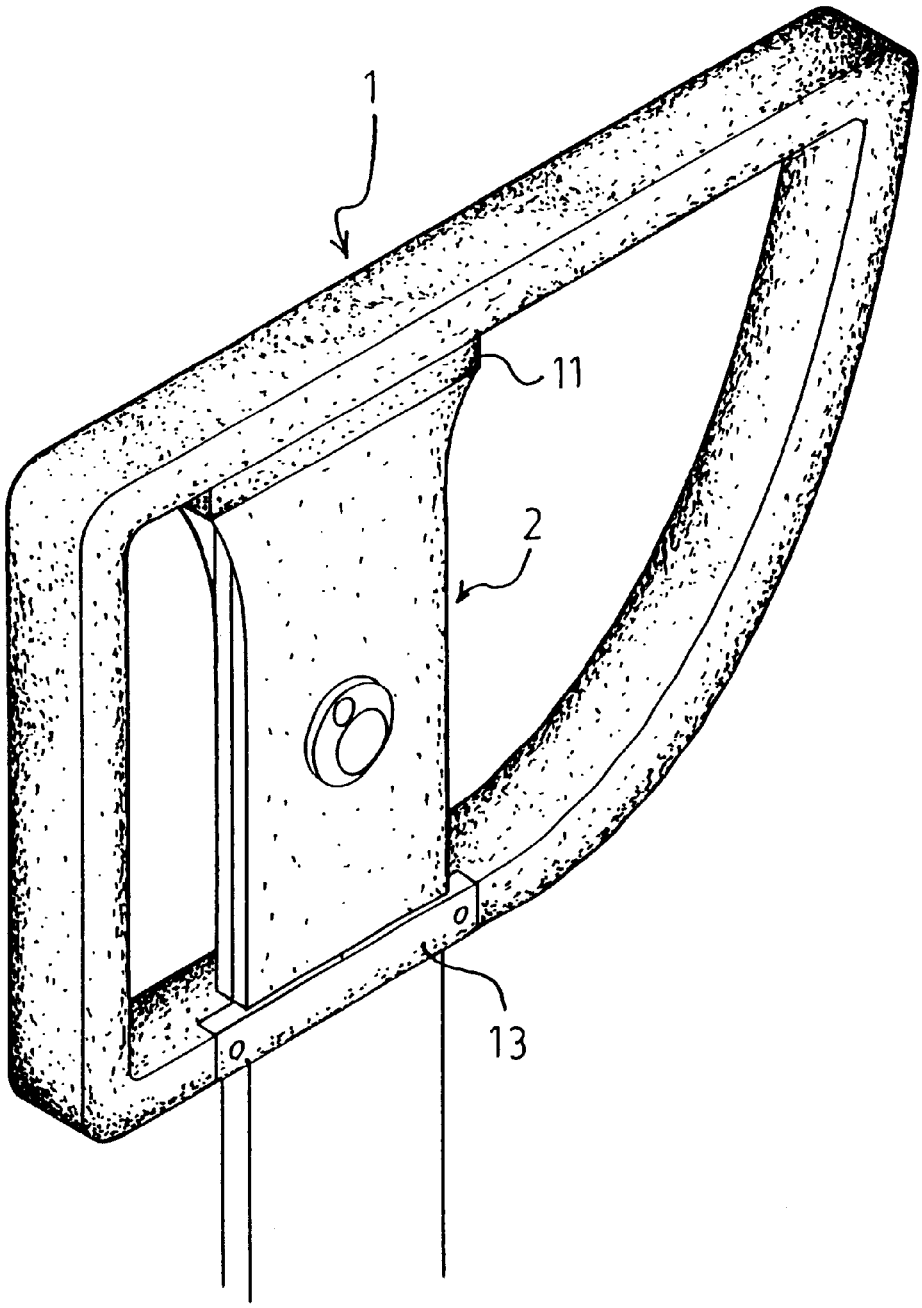
FIG. 6 is a perspective assembly view of an armrest support assembly of a third preferred embodiment in accordance with the present invention.

Referring to FIG. 6, a third armrest support assembly comprises a generally D-shaped armrest support frame 1 and an elevator seat 2.

The present invention is not limited to the above embodiments but various modifications thereof may be made. Furthermore, various changes in form and detail may be made without departing from the scope of the present invention.

I claim:

1. An armrest support assembly comprises:

an armrest support frame having an inner groove formed in a top portion of the armrest support frame and a stepped slot formed on a bottom portion of the armrest support frame, a positioning plate fastened to the bottom portion of the armrest support frame, an elevator seat passing through the stepped slot of the armrest support frame between the bottom portion of the armrest support frame and the positioning plate, and a top end of the elevator seat inserted in the inner groove of the armrest support frame.

2. The armrest support assembly as claimed in claim 1, wherein a threaded hole is disposed on each end of the stepped slot, and a through hole is disposed on each end of the positioning plate corresponding to the threaded hole when the positioning plate is fastened to the bottom portion.

3. The armrest support assembly as claimed in claim 2, wherein a bolt fastens each end of the positioning plate and the armrest support frame together via the respective through aperture of the positioning plate and the respective threaded hole of the armrest support frame.

4. The armrest support assembly as claimed in claim 2, wherein the armrest support frame has an L-shaped click hook disposed on each end of the stepped slot.

5. The armrest support assembly as claimed in claim 4, wherein the armrest support frame has a post disposed on each end of the stepped slot.

6. The armrest support assembly as claimed in claim 1, wherein the armrest support frame has an L-shaped click hook disposed on each end of the stepped slot.

7. The armrest support assembly as claimed in claim 6, wherein the armrest support frame has a post disposed on each end of the stepped slot.

8. The armrest support assembly as claimed in claim 1, wherein the armrest support frame has a post disposed on each end of the stepped slot.

* * * * *